United States Patent [19]

Newcomb et al.

[11] Patent Number: 4,563,726

[45] Date of Patent: Jan. 7, 1986

[54] ILLUMINATED CHEMILUMINESCENT DRINKING MUG

[76] Inventors: Nelson F. Newcomb; Nelson F. Newcomb, Jr., both of Mirror Lake, N.H. 03853

[21] Appl. No.: 642,399

[22] Filed: Aug. 20, 1984

[51] Int. Cl.[4] ..... F21K 2/00

[52] U.S. Cl. ..... 362/34; 362/96; 362/101; 362/294

[58] Field of Search ..... 362/101, 96, 34, 294

[56] References Cited

U.S. PATENT DOCUMENTS

| | | | |
|---|---|---|---|
| 1,843,512 | 2/1932 | Hutchison | 362/101 |
| 2,072,841 | 3/1937 | Tracey et al. | 362/101 X |
| 2,224,319 | 12/1940 | Schroyer | 362/101 |
| 2,709,217 | 5/1955 | McCluskey | 362/101 |
| 3,578,962 | 5/1971 | Gerber | 362/34 |
| 3,584,211 | 6/1971 | Rauhut | 362/34 |

*Primary Examiner*—Peter A. Nelson

*Attorney, Agent, or Firm*—C. Yardley Chittick

[57] ABSTRACT

A one piece illuminated drinking mug made of light permeable plastic, the mug wall being generally tubular with a flat bottom and having an axially disposed light permeable tube attached integrally to the bottom, the tube being longer than one half the vertical dimension of the mug, the tube being closed at its upper end and open at its lower end, said tube adapted to receive a light stick, and means for temporarily maintaining said light stick within said tube.

1 Claim, 6 Drawing Figures

ILLUMINATED CHEMILUMINESCENT DRINKING MUG

BACKGROUND OF THE INVENTION

The desirability of internally illuminating the liquid in a drinking glass has been long appreciated. See the Cahill U.S. Pat. No. 919,691, Stein U.S. Pat. No. 2,177,337, Schroyer U.S. Pat. No. 2,224,319, Simpson U.S. Pat. No. 2,663,866, Pardue U.S. Pat. No. 3,218,447, Rudolph U.S. Pat. No. 3,374,344 and Stott U.S. Pat. No. 3,735,113. All of the foregoing patented structures have relied on electrical light producing means. They are not currently available on the market probably because of cost, difficulty of cleaning for reuse and glass style.

SUMMARY OF THE PRESENT INVENTION

The liquid container of the present invention is made in one piece, preferably in mug form, of molded plastic. The plastic may be transparent or translucent and of any selected color.

In the preferred form, the mug will have a substantially flat circular bottom and a generally cylindrical wall integrally attached to the periphery of the bottom. The dimensions may be varied according to the liquid volume and stability desired. The mug in a preferred form will include a handle attached to the wall exterior.

The means for illuminating the liquid contents of the mug is of a novel inexpensive construction which permits repeated washings by conventional means without danger of breakage.

The light is provided by activation of a so-called light stick, a chemi-luminescent device made by American Cyanamid Company, Wayne, N.J. and sold under the trademark CYALUME. The light stick is removably mounted within the mug in the following manner. The mug bottom has a circular hole at its center. Extending axially upward from this hole and within the confines of the wall, is a plastic tube preferably of the same material as the mug, longer than the light stick and closed at its upper end. The tube is sealed to the bottom hole in liquid tight relation.

The interior diameter of the tube is such that it will readily accept insertion of an activated light stick. With the light stick in position within the tube it may then be temporarily secured therein by a removable closure plug inserted into the bottom end of the tube.

In this condition, the mug may then be filled with the potable liquid which will be pleasingly illuminated before and while it is being consumed by the user.

The illuminating life of the light stick permits several fillings and washings of the mug with the light stick remaining continuously in place in the tube. Leakage of liquid past the plug into the tube does not affect the operation of the light stick as it is a sealed unit. The lighting effect is greater with clear liquids and of course more obvious in darker surroundings.

The invention will be more particularly pointed out as the description proceeds with the aid of the accompanying drawings in which FIG. 1 is a side elevation of a mug made of translucent material in which the light stick supporting means is not visible.

DESCRIPTION OF A PREFERRED EMBODIMENT

Figures 1, 2, 3, 4, 5, 6:
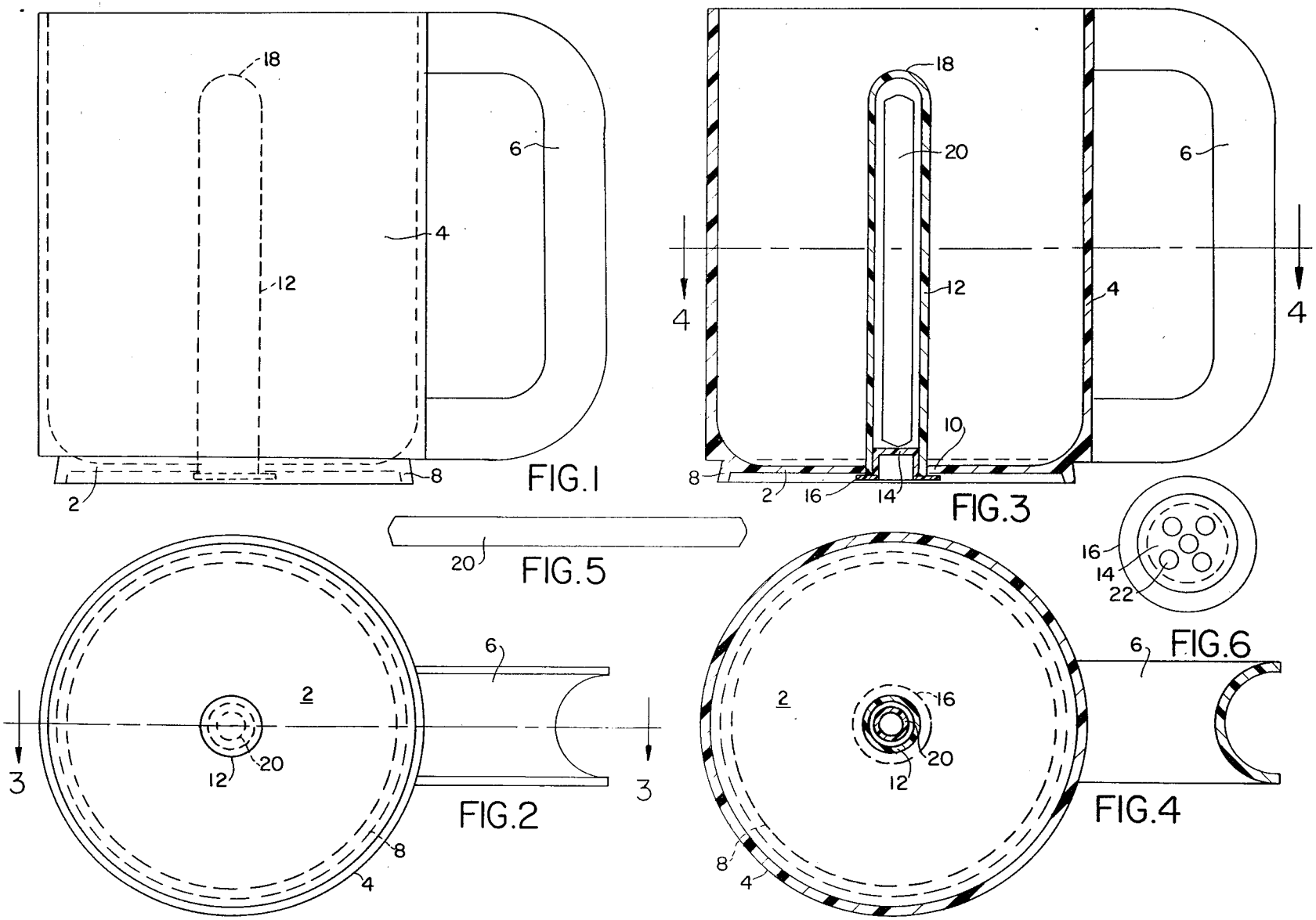
FIG. 2 is a plan view of FIG. 1.
FIG. 3 is a vertical section of the mug, taken on the line 3—3 of FIG. 2.
FIG. 4 is a horizontal section of the mug taken on the line 4—4 of FIG. 3.
FIG. 5 shows an individual light stick adapted to be used with the mug.
FIG. 6 is an enlarged view of the plug for closing the bottom of the post.

Referring to FIGS. 1 to 4, the mug, which in a preferred size may hold about a pint of liquid, is comprised of a bottom 2, an upper generally cylindrical wall 4 integral with the periphery of the bottom. A handle 6 is secured to the wall 4.

The bottom 2 has a circular dependent outer supporting rim 8 sized to fit within the top of wall 4 of a mug placed thereunder whereby the units may be readily stacked.

The bottom 2 has a centrally located hole 10 therethrough adapted to receive the lower end of a hollow post 12 hereinafter referred to as the light stick post. This post is secured to the bottom in water tight relationship. The lower end of the post is open but may be closed by a manually removable plug 14. Plug 14 has a circular flange 16 to limit the distance the plug may be inserted in post 12 and to facilitate its removal. The top of light stick post is closed as at 18.

A conventional chemi-luminescent device 20 referred to as a light stick is shown in FIG. 5. In the preferred arrangement the post 12 will be sized to accept the light stick 20. Since the illuminating capacity of a light stick may be considered as roughly proportional to its size, it is preferred that the post 12 be of a length capable of receiving the longest available light stick of less length than the depth of the mug. The currently available 3 inch light stick made by American Cyanamid Company meets this requirement. The 3 inch light stick has an operating life of over three hours and an illuminating capacity capable of penetrating the translucent post 12, and the translucent wall 4 while simultaneously lighting whatever potable liquid may be poured into the mug.

The procedure in utilizi g the parts heretofore described is as follows. When a drink is called for, the bartender will place a light stick 20 in operative condition by bending it as required to allow the chemicals to mix to produce cold light. The light stick 20 is then placed in post 12 and secured therein by insertion of plug 14 into the bottom end of post 12. The light stick is now in sealed condition within post 12 and will continuously produce light for several hours.

The bartender then fills the mug with the desired drink ready for consumption by the patron. The liquid in the mug will be illuminated in a pleasing manner by the light emanating from post 12, the light passing through the liquid and the mug wall 4.

Because of the longevity of the light producing capacity of the light stick, the mug may be refilled as desired or washed and set aside for subsequent use within the time available.

It will be understood that there are to be no limitations as to dimensions of the size of the mug or the materials of which the mug is made other than that the material comprising post 12 and the wall 4 of the mug must permit adequate transmission of light so that the liquid will be pleasingly illuminated to the drinker.

MODIFICATION OF THE INVENTION

A known characteristic of the Cyalume light stick is that its light output is diminished by decreasing its temperature. Accordingly, it has been found that when the drink in the mug is of the type requiring that it be very cold and so maintained by the presence of actual ice in the mug, the post 12, the air therewithin and the light stick 20 may be cooled to such extent that the lighting effect will be undesirably lessened.

To minimize decreasing the temperature of the light stick in those drinking situations in which the liquid is to be iced, we have found that this may be readily accomplished by making the post somewhat larger in diameter thereby substantially increasing the air volume that surrounds the light stick. This increase in air volume appreciably slows down the temperature drop of the light stick so that the drink may be consumed before the drinker is aware of any change in the lighting effect. The slowing process may be aided by perforating plug 14 permitting the entrance into post 12 by thermal circulation of the higher temperature outside ambient air. Such perforations are shown at 22 in the enlarged view of plug 14 in FIG. 6.

It is intended to cover all changes and modifications of the example of the invention herein chosen for purposes of the disclosure which do not constitute departures from the spirit and the scope of the invention.

We claim:

1. A molded plastic drinking mug comprising a substantially flat circular bottom, a light transmitting circular wall extending upward from the periphery of said bottom and integral therewith, said bottom and wall defining a liquid container, a hole through said bottom, an elongated vertically disposed light transmitting hollow post closed at its upper end and extending upwardly from said bottom and attached at its lower open end to the boundary of said hole, said post being wholely within the confines of said wall and having a vertical dimension of at least three inches which said dimension is also greater than one half the height of said wall, a vertically disposed chemiluminescent light stick removably positioned within said post, removable means at the lower end of said post for maintaining said chemiluminescent light stick within said post, said chemiluminescent light stick being of a length that is greater than one half the height of said wall but less than the said vertical dimension of said post and having a lighting life of at least three hours and a circular concentric supporting rim extending downward from said bottom, the exterior diameter of said rim being slightly less than the interior diameter of the top of said wall, whereby said mug may be securely stacked on another identical mug therebelow.

* * * * *